US008550648B2

(12) United States Patent
Smith

(10) Patent No.: US 8,550,648 B2
(45) Date of Patent: Oct. 8, 2013

(54) DIRECTIONAL HANDS-FREE WRIST ILLUMINATION DEVICE

(76) Inventor: Kurtice Smith, Groves, TX (US)

( * ) Notice: Subject to any disclaimer, the term of this patent is extended or adjusted under 35 U.S.C. 154(b) by 107 days.

(21) Appl. No.: 13/162,752

(22) Filed: Jun. 17, 2011

(65) Prior Publication Data

US 2011/0310592 A1 Dec. 22, 2011

Related U.S. Application Data

(60) Provisional application No. 61/355,577, filed on Jun. 17, 2010.

(51) Int. Cl.
*F21V 21/08* (2006.01)

(52) U.S. Cl.
USPC ..... 362/103; 362/235

(58) Field of Classification Search
USPC ..... 362/103, 184, 190, 208, 249.12, 195
See application file for complete search history.

(56) References Cited

U.S. PATENT DOCUMENTS

| | | | | | |
|---|---|---|---|---|---|
| 3,944,803 | A * | 3/1976 | Chao | 362/108 |
| 3,975,899 | A * | 8/1976 | Haber | 368/280 |
| 4,173,201 | A * | 11/1979 | Chao et al. | 119/859 |
| 4,521,832 | A * | 6/1985 | Barbour | 362/103 |
| 4,523,258 | A * | 6/1985 | Morse et al. | 362/108 |
| 4,788,631 | A | 11/1988 | Fuller | |
| 4,812,953 | A * | 3/1989 | Ask et al. | 362/103 |
| 4,910,652 | A | 3/1990 | Rhine | |
| D353,033 | S * | 12/1994 | Johanson | D29/101.5 |
| 5,568,971 | A | 10/1996 | Jewell | |
| 6,012,822 | A * | 1/2000 | Robinson | 362/103 |
| 6,213,619 | B1 | 4/2001 | Yu | |
| 6,578,982 | B1 * | 6/2003 | Lynch | 362/104 |
| 6,644,826 | B1 * | 11/2003 | Blum | 362/183 |
| D596,325 | S | 7/2009 | Barbour | |
| 2006/0198120 | A1 * | 9/2006 | Guzman | 362/103 |

* cited by examiner

*Primary Examiner* — Ali Alavi
(74) *Attorney, Agent, or Firm* — Daniel Boudwin

(57) ABSTRACT

A lighting device designed to for attachment around the wrists of a user. The device is a material band equipped with a plurality of forward facing lights to illuminate an area in front of the user's hands. Further, the device is equipped with a clasp to allow securing to the wrist. An on off switch is used to control an illumination, while an internal battery powers the lights. The lighting device provides adequate lighting for manual work such as car repairs as well as for vision during nighttime excursions.

5 Claims, 2 Drawing Sheets

DIRECTIONAL HANDS-FREE WRIST ILLUMINATION DEVICE

CROSS REFERENCE TO RELATED APPLICATION

This application claims the benefit of U.S. Provisional Application No. 61/355,577 filed on Jun. 17, 2010, entitled "Wrist Light."

BACKGROUND OF THE INVENTION

1. Field of the Invention

The present invention relates to a flashlight. More specifically, the present invention relates to an illuminating device that may be removeably affixed to a user's wrist, allowing the performance of tasks with a hands-free light source.

Lighting equipment may be required for the performance of certain tasks. Mechanics, for example, may need flashlights or drop lights to view the intricate systems within a vehicle cavity that would otherwise be difficult or impossible to see. However, extra lighting aids can be cumbersome and difficult to use while trying to work. Additionally, individuals who run or walk outside for exercise may like to bring water, music device or similar handheld article with them on their excursions, requiring the use of both hands. If they are outside when night falls, however, they must have lights handy to ensure that they can be seen and be avoided by motorists, as well as visualize the path in front of them as they walk or run. Carrying a flashlight and other devices may take up one or more hands, requiring users to choose between carrying lights and other devices they may require. Similarly, those that walk their dogs at night would benefit from having both hands free to carry a leash and another handheld device.

The present invention addresses the need to free a user's hands while performing activities in low light situations by providing a wrist affixing, hands-free lighting solution.

2. Description of the Prior Art

Patents have previously issued that disclose hands-free lighting devices that address similar issues. These prior art devices have several known drawbacks and fail to fulfill the needs addressed by the present invention.

Several patents have issued for devices directed to wrist illumination devices, each having a significant drawback. Barbour U.S. Pat. No. 4,521,832 is directed to an illuminating device designed to distribute light in a working area without requiring the user to employ a flashlight. Primarily, the Barbour invention consists of a wrist strap of foam plastic, having a self-contained and replaceable battery, held in place by hook and loop fasteners. It further includes a plurality of spaced bulbs to provide light for the user to work by while leaving the user's hands free of objects. Additionally, Barbour U.S. Design Pat. No. D596,325 is directed to an ornamental design for a wrist light. The Barbour inventions define a wrist light with only a limited number of lights; specifically only four lights are claimed. In many situations, such limited illumination will not be sufficient or may be blocked by the wrist of the user. The present invention addresses this need by providing lighting around the entire circumference of the wrist, in addition to offering an improved and less cumbersome design.

Several issued patents describe inventions with only a single light source. Fuller U.S. Pat. No. 4,788,631 is directed to a wrist-mounted flashlight having a sliding lens. The lens has a white light section and a red light section. The case of the flashlight contains batteries and electrical contacts. The bulb in mounted at an inclination relative to the wrist-contacting surface of the case. The bulb extends into a space between the batteries.

Similarly, Jewell U.S. Pat. No. 5,568,971 is directed to a wrist mounted light source including a generally cylindrical central housing. The device has an upper surface having an opening centrally located therein and a lower surface having an opening therein. A surrounding sidewall has a first opening and a second opening therein. A battery is secured within the central housing as well as an upper light. The upper light electrically couples to the battery. A side light is secured within the central housing inwardly of the first opening in the surrounding sidewall thereof and is electrically coupled with the battery. A power switch is secured within the second opening of the surrounding sidewall of the central housing. The power is electrically coupled to the battery, the top light and the side light.

Additionally, Yu U.S. Pat. No. 6,213,619 is directed to a flashlight assembly that is mountable onto a user's wrist to provide a light source which is pivotable in two planes of motion. The assembly includes a housing that is pivotably mounted on a wristband. The housing includes a light source that is pivotably mounted thereto.

The Fuller, Jewell and Yu inventions consist essentially of a single light source attached to the wrist, and as such will provide only limited illumination. Additionally, if the wrist flexes in a certain manner, the wrist blocks the light entirely. The present invention addresses this by mounting lights around the entire circumference of the wrist to provide sufficient illumination in all instances.

Other inventions are directed to remedying issues only tangentially related to those addressed by the present invention. Ask U.S. Pat. No. 4,812,953 is directed to a safety light band that maximizes the visibility of a pedestrian wearing the band in poorly lit or unlighted conditions. The band is formed as a flexible strap having fastening means for wearing the band on the person, and luminous means comprising an interactive combination of electric lamps and reflective surfaces. The Ask invention is designed to address the issue of personal visibility at night. While the present invention may be used in a manner that provides additional visibility, the primary issue addressed is providing illumination for work being performed.

Similarly, Rhine U.S. Pat. No. 4,910,652 is directed to an analog watch for training children to read the current time having a flashlight installed in the watchcase. The flashlight power supply is connected to the light emitting flashlight bulb through an electrical circuit that automatically turns the flashlight off after a time delay to preserve battery power. The watch time indicating face has numbers and dots to represent hours, and numbers and dots that represent minutes. The Rhine invention is directed away from the issues of the present invention, and specifically addresses the issue of teaching children to read a wristwatch.

Finally, other publications are directed to illumination only in a decorative sense. Lynch U.S. Pat. No. 6,578,982 is directed to a strap-like item of wearing apparel having studs capable of illumination. A light-emitting diode (LED) is disposed within each stud. The LED's are activated by means of a circuit. The Lynch invention, while serving as a trendy accessory, does not address the issue of providing illumination sufficient to allow the user to perform manual tasks with their hands. The present invention is designed to address this need.

While some patents have issued regarding wrist lighting devices, there is no device in the prior art that suitably addresses the need for a lightweight, directed, and wrist-worn light. The prior art inventions offer single or limited lighting and do not provide light around the total circumference of the practitioner's wrist. The present invention addresses a need in the art, and subsequently it is clear that it provides a new structure that fulfills these needs.

SUMMARY OF THE INVENTION

In view of the foregoing disadvantages inherent in the known types of wrist mounted lights now present in the prior art, the present invention provides a new wrist light wherein the same can be utilized for providing convenience for the user when performing manual tasks with their hands that requires illumination.

The present invention provides total illumination around the circumference of a practitioner's wrist and directed outward for forward illumination of a work area or forward path. The device provides light for those who work or participate in recreational activities in dark areas or poorly lit areas. The device eliminates the need to carry cumbersome pieces of handheld lighting equipment or head-strap flashlights for safe and effective lighting. Mechanics, divers, runners, and other practitioners who frequently take walks will find this invention to be very beneficial in dimly lit areas.

It is therefore the principal object of this invention is to provide a wrist strap-illuminating device, which will be employed to produce light emanating from around the full circumference of the wrist without the need of holding an article, such as a flashlight.

Another object of this invention is to provide a wrist strap-illuminating device, which will be of such design as to employ a plurality of small light bulbs therein, facing forward in a circle. The bulbs may be of any type sufficient for the given task, including incandescent, LED or equivalent. Further, the device will include a self-contained switch and battery means for its operation.

Yet Another object of this invention is to provide a wrist strap illuminating device, which employs adjustment means so as to be moved forward and rearward on the user's wrist, as well as enabling it to fit various wrist sizes.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself, and manner in which it may be made and used, may be better understood by referring to the following description taken in connection with the accompanying drawings.

DETAILED DESCRIPTION OF THE INVENTION

Figure 1:
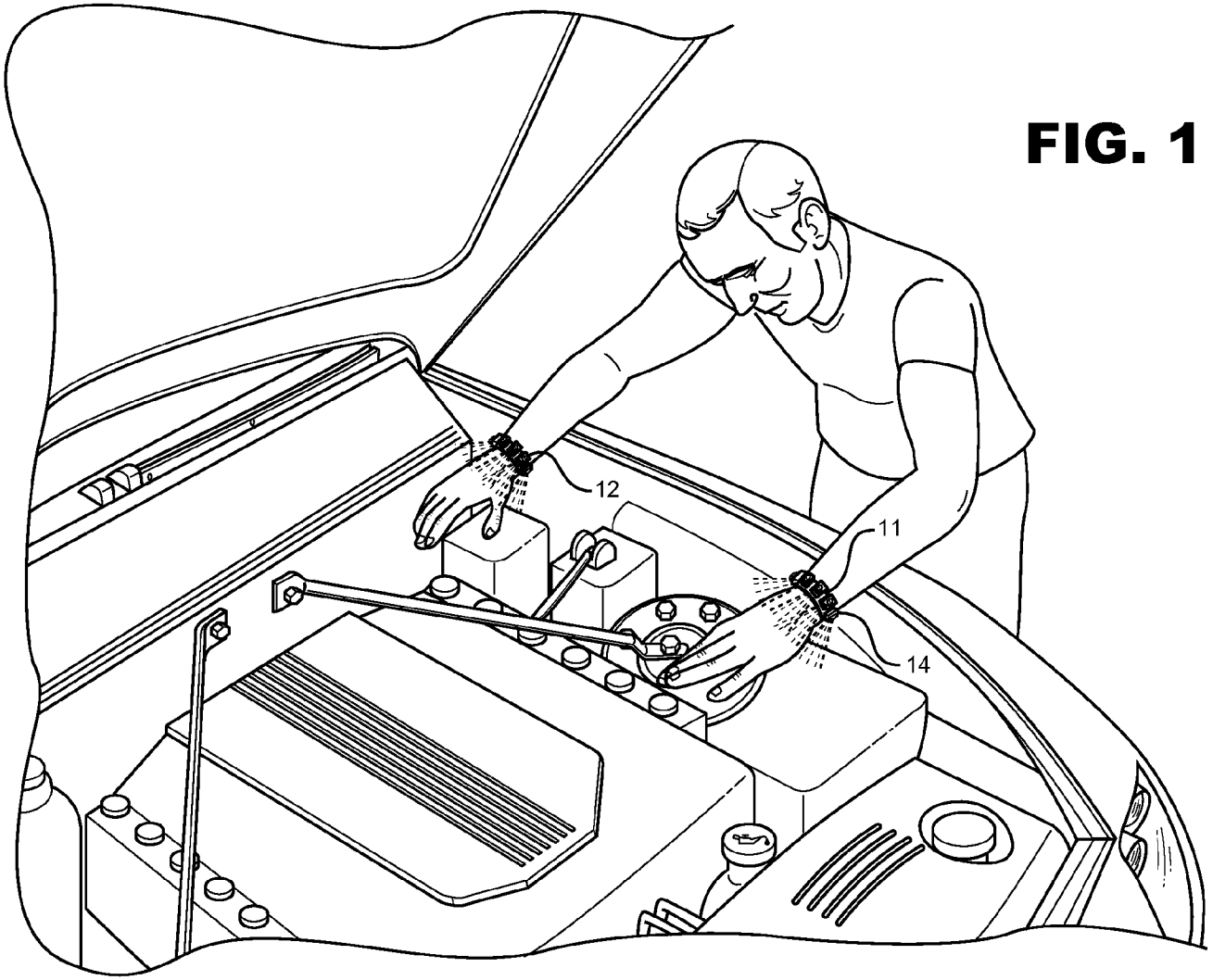
FIG. 1 is a perspective view of the present invention in use illuminating a working area within a vehicle cavity.

Referring now to FIG. 1, there is shown a perspective view of the present invention in use illuminating a working area within a vehicle cavity. The present invention may primarily be used for the illumination of a working area, such as under the hood of a car, in tight spaces where lighting is required or in specific work environment where hands free operation is critical for the work at hand and while illumination is limited. The device has a material band 11 for fastening around the wrist of a user. Attached to the material band 11 is a plurality of lights 12. The plurality of lights 12 are housed within individual housing units 14 and powered by a central battery. In a preferred embodiment, the lights 12 are high output Light Emitting Diodes (LEDs), which consume far less energy than incandescent bulbs, are more compact and project a specific wavelength light if desired. Very clear, high intensity light is possible from these types of bulbs, all while consuming minimal power from an onboard battery.

Figure 2:
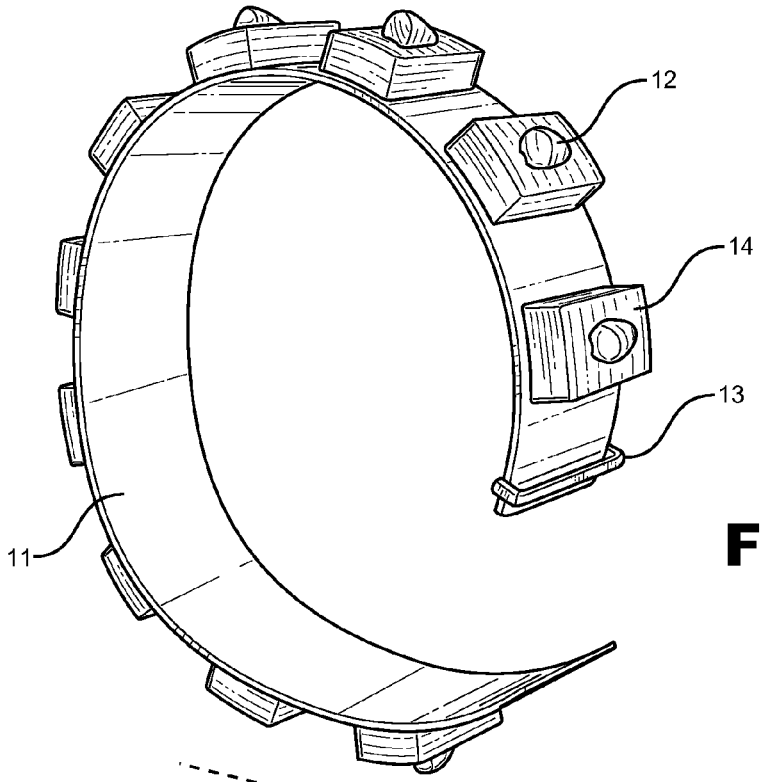
FIG. 2 is a perspective view of the present invention in an unclasped state with circumferential lights deactivated.

Referring now to FIG. 2, there is shown a perspective view of the present invention in an unclasped state with its circumferential lights deactivated. The structure of the device is shown in detail, including the material band 11, the plurality of attached lights 12 and corresponding housing units 14. The plurality of lights 12 face in a unidirectional manner, allowing their beams to focus forward for lighting a defined area in front of the user's hands. The plurality of lights 12 are housed within individual housing units 14, which enclosure the lighting structure and necessary electronics. For the preferred embodiment, this includes housing the LED itself and any circuitry required to route current from a battery source through the diode for illumination purposes. Each light 12 provides a directional covering for projecting the supplied light in a single direction, as previously mentioned for illumination in front of the user's hands. This is particularly useful in working situations, wherein a user is required to hold a tool or other device to complete a task in a dimly lit environment. Further, a clasp 13 will be affixed to the material band 11, allowing the user to secure the device to his wrist.

Figure 3:
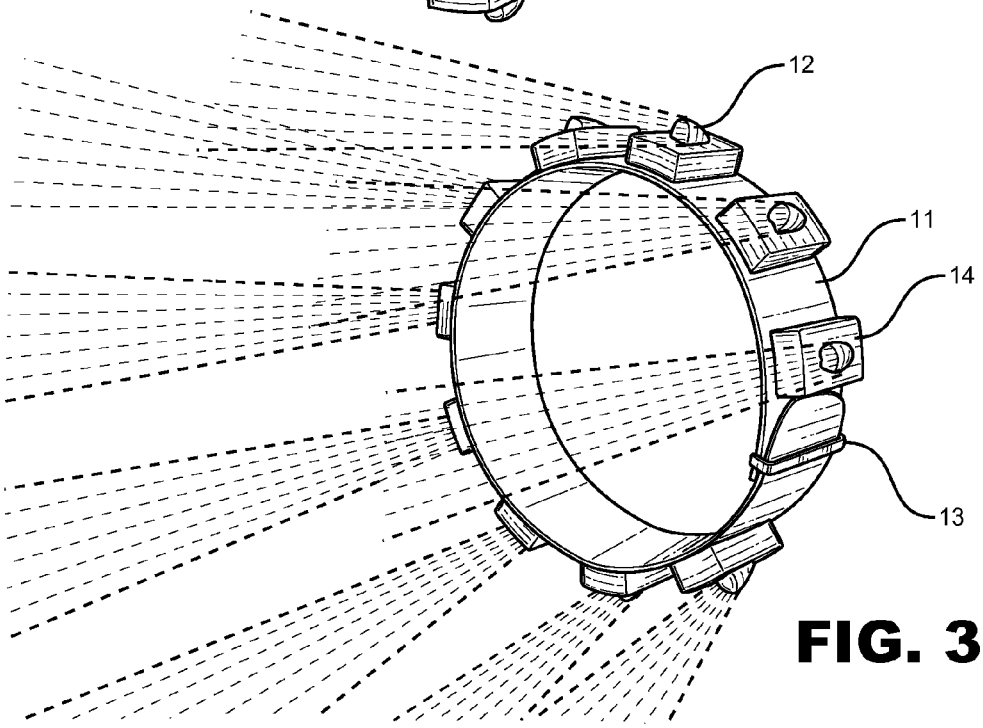
FIG. 3 is a perspective view of the present invention in a clasped state as if being worn, with the circumferential lights activated.

Referring now to FIG. 3, there is shown a perspective view of the present invention clasped as if worn with the lights 12 activated. The plurality of lights 12 are focused forward to illuminate a defined working area if attached to a user's wrists. The plurality of lights 12 are housed within individual housing units 14. Further, the material band 11 is secured closed using the attached clasp 13. The lights provide a projection of light forward, which can be tailored to fit a given task. For certain activities, higher intensity and more directed light would be desirable, while activities in open areas may require a broader projection area for increased visibility. It is not desired to limit the present invention to a particular activity, light source or projection area, but rather to describe an illuminating wrist light device for providing hands-free operation by the user while carrying a light source on his or her wrist.

In use the present invention provides consumers with a hands-free, portable lighting device that can be used for virtually any task that is performed in the dark. The device comprises an adjustable material band 11 made of any suitable flexible fabric, leather, synthetic material, plastic or rubber. At each end of the band can be one or more fastening devices, such as a clasp 13, hook and loop fastening or other clasping or attaching means that allows the material band 11 to attach around a user's wrist. Around the entire outer circumference of the material band 11 may support a plurality of lights 12 designed to direct light in a directional manner toward the user's fingers with a given projection area at a specific distance.

The plurality of lights 12 may be LEDs or any other suitable type of illuminating device. The plurality of lights 12 may be housed securely in housing units 14 which confine the light source, direct electric current therefor and provide a means to direct the light in a forward direction. The lights 12 may be turned on and off by a switch provided on the wristband. Additionally, the lights 12 may be battery-powered, wherein the battery is housed in a particular housing. Electrical connection between housings 14 is provided beneath, through or above the wristband 11, providing electrical power to all housings 14 simultaneously or in a pattern that would allow certain lights or intensities thereof to be utilized at a given time. The invention may be made available in a variety of colors to suit user preferences and may be waterproof for use while diving, running in the rain, or other various wet conditions.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrist-strap illuminating device comprising:

a wrist band having first and second ends;

said wrist band having an attachment means to removably secure said first end to said second end;

light sources mounted within a plurality of housing units protruding upward from and staggered along an upper surface of said wrist band wherein said housing units have a flat upper surface and a plurality of sidewalls;

a directional covering disposed on said upper surfaces of said housing units, having an opening at one end of said directional covering and partially obscuring said light sources thereby directing emitted light out of said opening;

wherein all of said directional coverings are oriented in the same direction;

a battery power supply electrically connected to said light sources;

and switch for controlling said electrical power to said light sources.

2. A device as in claim 1, further comprising housing constructed to be waterproof.

3. A device as in claim 1, wherein said light sources are Light Emitting Diodes.

4. A device as in claim 1, wherein said switch controls the illumination intensity of said light sources.

5. A device as in claim 1, wherein electrical connections between said housings and said battery power supply are routed along said wrist band.

* * * * *